US008217798B2

(12) United States Patent
Lontka et al.

(10) Patent No.: US 8,217,798 B2
(45) Date of Patent: Jul. 10, 2012

(54) SYSTEM, CONVERTER AND METHOD FOR WIDE AREA DISTRIBUTION OF SUPERVISED EMERGENCY AUDIO

(75) Inventors: Karen D. Lontka, Randolph, NJ (US); Lev M. Barsky, New York, NY (US); Paul Strelecki, Whitehouse Station, NJ (US)

(73) Assignee: Siemens Industry, Inc., Alpharetta, GA (US)

( * ) Notice: Subject to any disclaimer, the term of this patent is extended or adjusted under 35 U.S.C. 154(b) by 440 days.

(21) Appl. No.: 12/502,787

(22) Filed: Jul. 14, 2009

(65) Prior Publication Data

US 2010/0013643 A1 Jan. 21, 2010

Related U.S. Application Data

(60) Provisional application No. 61/080,789, filed on Jul. 15, 2008.

(51) Int. Cl.
*G08B 17/12* (2006.01)

(52) U.S. Cl. ..... 340/577; 340/628; 340/692

(58) Field of Classification Search ..... 340/577, 340/628, 692, 506; 381/111, 120
See application file for complete search history.

(56) References Cited

U.S. PATENT DOCUMENTS

| | | | | |
|---|---|---|---|---|
| 7,148,810 | B2 * | 12/2006 | Bhat | 340/692 |
| 7,428,311 | B2 * | 9/2008 | Curran et al. | 381/120 |
| 7,643,894 | B2 * | 1/2010 | Braithwaite et al. | 700/94 |
| 2005/0113947 | A1 * | 5/2005 | LeBlanc et al. | 700/94 |
| 2005/0231349 | A1 | 10/2005 | Bhat | 340/506 |
| 2006/0168114 | A1 | 7/2006 | Glatron | 709/218 |
| 2008/0109095 | A1 | 5/2008 | Braithwaite | 700/94 |
| 2008/0249642 | A1 * | 10/2008 | Chen | 700/17 |

OTHER PUBLICATIONS

Renesas, M65856SP Digital Echo with Mic-mixing Circuit, pp. 1-3, 5 and 8, XP002549645, Sep. 22, 2003.
PCT Search Report and Written Opinion for International Application No. PCT/US2009/050623 dated Oct. 21, 2009.

* cited by examiner

*Primary Examiner* — Toan N Pham

(57) ABSTRACT

A wide area fire safety and detection system is disclosed. The system includes a control node configured to execute a first detection routine, wherein the control node has a network interface, and an amplifier having an audio output, wherein the amplifier is configured to communicate the audio output to a plurality of fire safety nodes. The system further includes a remote node in communication with the control node, wherein the remote node has a network interface configured for communication with at least the network interface of the control node, and an audio converter configured to receive the audio output and generated a converted audio output, wherein the converted out is compatible with a microphone input.

11 Claims, 2 Drawing Sheets

SYSTEM, CONVERTER AND METHOD FOR WIDE AREA DISTRIBUTION OF SUPERVISED EMERGENCY AUDIO

PRIORITY CLAIM

This patent document claims the priority benefit provided under 35 U.S.C. §119(e) to U.S. provisional patent application Ser. No. 61/080,789, filed on Jul. 15, 2008. The content of this provisional patent application is incorporated herein by reference for all purposes.

TECHNICAL FIELD

This patent generally relates to an exemplary fire safety system, and specifically to the conversion and distribution of emergency audio through the exemplary fire safety system.

BACKGROUND

Known fire alarm monitoring and reporting systems typically utilize proprietary and/or customized techniques, formatting and encoding for the distribution of audio communications throughout a wide area alarm and/or monitoring network. This proprietary and customized formatting of information may further complicate integrating technologies and components of different fire monitoring and reporting systems which may occur during, for example, system maintenance cycles, system upgrades or simply when two or more systems are to being combined or organized into a single integrated system. Moreover, some known systems simply do not include the desirable functionality. For example, some known systems or integrated cluster of systems make lack the functionality or interoperability necessary to implement global or system-wide paging or communication.

SUMMARY

In one exemplary embodiment, a wide area fire safety and detection system is disclosed. The system includes a control node configured to execute a first detection routine, wherein the control node has a network interface, and an amplifier having an audio output, wherein the amplifier is configured to communicate the audio output to a plurality of fire safety nodes. The system further includes a remote node in communication with the control node, wherein the remote node has a network interface configured for communication with at least the network interface of the control node, and an audio converter configured to receive the audio output and generated a converted audio output, wherein the converted out is compatible with a microphone input.

In another exemplary embodiment, an audio converter is disclosed. The audio converter includes a first audio input configured to receive a first audio output from a first amplifier, a second audio input configured to receive a second audio output from a second amplifier, an audio converter module configured to convert the first audio output from a first audio format to a second audio format and configured to convert the second audio output from a third audio format to a second audio format, and an audio output configured to communicate a third audio output in the third audio format to a microphone input.

In another exemplary embodiment, a method of audio communication is disclosed. The method includes receiving a first audio input provided by a first audio output of a first amplifier, receiving a second audio input provided by a second audio output of a second amplifier, converting the first audio output from a first audio format to a second audio format, and converting the second audio output from a third audio format to the second audio format, and communicating a third audio output in the second audio format to a microphone input.

Other embodiments are disclosed, and each of the embodiments can be used alone or together in combination. Additional features and advantages of the disclosed embodiments are described in, and will be apparent from, the following Detailed Description and the figures.

DETAILED DESCRIPTION

The present patent and disclosure presented herein address the limitation and shortcomings of the known fire alarm and monitoring systems. In one embodiment of a fire alarm monitoring and reporting system is a FireFinder XLS (XLS) provided by SIEMENS BUILDING TECHNOLOGIES of Buffalo Grove, Ill. In particular, the exemplary embodiment disclosed herein provides the ability to connect a live or global paging microphone across multiple XLS voice systems. Moreover, the teaching or disclosure provided herein may be utilized to interconnect multiple previously-incompatible known fire alarm monitoring and reporting systems to provide the desirable live or global paging capability.

Figure 1:
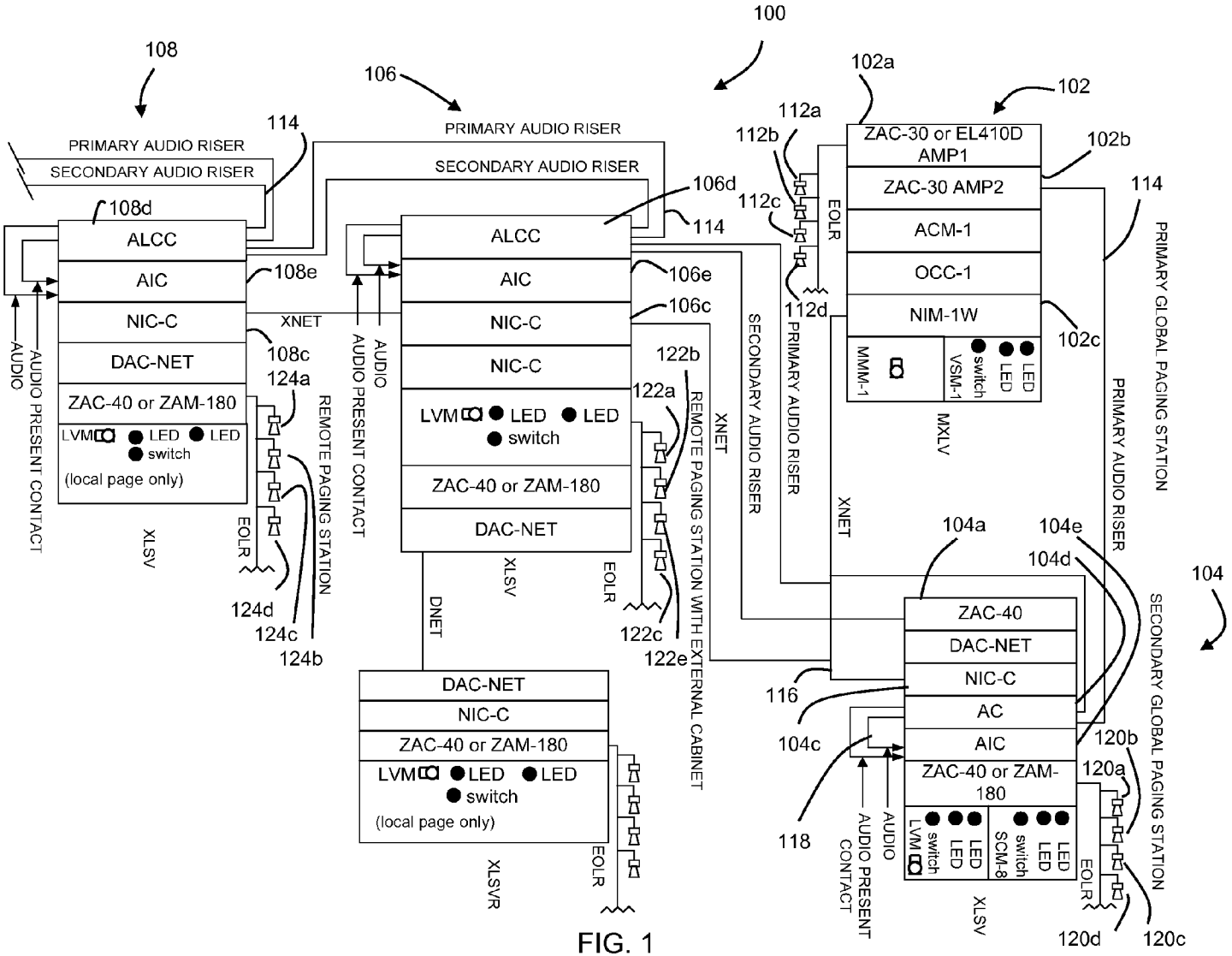
FIG. 1 illustrates an embodiment of an exemplary fire alarm monitoring and reporting system configured according to the teaching provided herein.

FIG. 1 illustrates an embodiment of an exemplary fire alarm monitoring and reporting system 100 configured according to the teaching provided herein. The system 100 includes a primary or control node 102 in communication with a plurality of secondary or remote nodes 104 to 108. The control node 102, in this exemplary embodiment, may be a rack-mounted and/or expanded controller utilizing one or more processors in communication with a memory having executable instructions stored thereon. For example, the memory may be a hard drive, RAM or ROM configured or programmed to store instructions necessary to operate the control node 102 (and/or remote nodes 104 to 108.) In another embodiment, the control node 102 may be a single integrated device utilizing special purpose hardware, expansion cards or other known analog or digital elements.

The control node 102 may further include an amplifier 102*a* configured to generate an audio output 110 to drive or otherwise activate one or more speakers such as the emergency indicators 112*a* to 112*d*. The control node 102 may further include a second amplifier 102*b* to drive or otherwise communicate a global paging output 114. Alternatively, the audio output 110 may be split and utilized to drive the global paging feature provided by the exemplary fire alarm monitoring and reporting system 100.

The control node 102 may further include a network interface or communication module 102*c* configured to provide communications throughout the exemplary fire alarm monitoring and reporting system 100. For example, the communication module 102*c* may provide addressable communications between the plurality of secondary or remote nodes 104 to 108. The communications between the plurality of secondary or remote nodes 104 to 108 may be conducted according to TCP/IP or other known networking and/or wireless (e.g., 802.15, 802.11x) communications standards.

The control node 102 (via the communication module 102*c*) may be arranged in communication with the secondary or remote node 104 via a communication module 104*c*. The communication, data, status and control information may be transmitted via a line or cable 116 such as a two-wire arrangement, Ethernet cable or other known communication mechanism.

The control node 102 may further communicate with the remote node 104 via the global paging output 114 communicated or outputted by the amplifier 102*b*. The global paging output 114 may, in turn, be received by an audio converter 104*d* (AC). The AC 104*d* may be a card, module or other device configuration.

The AC 104*d* allows the amplifier 102*b* from, for example, one XLS system such as the control node 102, to be used as a source of global paging audio. The global paging output 114 of the amplifier 102*b* connects to an input of the AC 104*d* or the equivalent deployed in each of the remote node 104 to 108. The AC 104*d* may include a pass-through port 104*e* to provide or communicate the global paging output 114 to the remaining remote nodes 106 and 108. The AC 104*d* then provides and converts the incoming speaker level audio signal to a low level signal 118 that is compatible with an audio input module or card 104*e* (AIC). The AC 104*d* may prioritize the communication of a given output based on, for example, the presence or absence of an active signal and/or detection of on-board faults or problems. The AIC 104*e* can then selectably connect the audio from the global paging input to the local paging channel of the fire alarm monitoring and reporting system 100. In alternate embodiments, the AC 104*d* may configured to convert the output from any wattage (e.g., 30 W, 40 W and 180 W) amplifier or from any format or type of output received from one or more system utilizing a different protocol or communication format. In some embodiments, output(s) of the AC 104*d* may be isolated from the host system 100 with DC/DC converters and optocouplers (not shown). This configuration provides isolation between the source amplifier 104*b* at the global paging station 102 and the remote paging stations 104 to 108.

The AC 104*d* minimizes the design, manufacturing and maintenance impact on the fire alarm monitoring and reporting system 100. The exemplary global paging configuration utilizes existing amplifiers and audio input cards or their equivalents in the various nodes of the fire alarm monitoring and reporting system 100. Thus, global paging capability can be added to existing fire alarm monitoring and reporting systems without the need to modify or upgrade hardware. The global paging capability may be controlled and directed to specific speaker or system zones utilizing commands and/or control instructions communicated and received via communications modules 102*c* and 104*c*, respectively.

In a typical system configuration, AC 104*d* may be configured to utilize as many existing pieces of the fire alarm monitoring and reporting system 100 as possible. The AC 104*d* may be utilized as the source of paging audio for a given voice system. Amplifiers 102*b* and 104*b* such as, for example, ZAC-40, ZAM-180, and ZAC-30 amplifiers provided by SIEMENS BUILDING TECHNOLOGIES, may be utilized to connect any system audio, including paging, to the speakers (e.g., 120*a* to 120*d*) in a building. In this way, the AC 104*d* allows the output of the amplifier 102*b* to connect to an input of the AIC 104*e*. This connection is transparent to the fire alarm monitoring and reporting system 100 and requires little or no additional development software or configuration to enable basic functionality. In this way the output of the control node 102 can be connected to any remote node 104 to 108 and AC 104*d* to 108*d*.

The AC 104*d* may be implemented according to, for example, UL 864 section 34.2.3.1, as an all-analog card. The all-analog nature of this implementation may limit fault or other data communication thereby requiring communication of more data via the network established by the network interface communication modules 102*c* to 104*c*. The AIC 104*e* may supervise or monitor the low level signal 118 to detect the loss of audio conditions or other communications problems. The AC 104*d* may further provide visual status and monitoring information also reports faults visually.

In order to implement this approach, the AC 104*d* must output an audio signal of sufficient amplitude to the input of the AIC 104*e*. The AC 104*d* may also provide a dry contact for the AIC 104*e* that indicates the presence of live paging audio. This contact closure may signal the presence of a signal or communication for transmission. In one embodiment, the AIC 104*e* reports faults to the overlying system 100. The input(s) to the AC 104*d* may be, in turn, supervised and reported by the originating amplifiers 104*b*. In addition, the AC 104*d* may supervise itself, display faults visually, and report a fault by cutting the supervisory signal to the AIC 104*e*, which subsequently reports the fault, as described above.

Each of the remote nodes 106 and 108 may further be in communication with the control node 102 and remote node 104. The remote nodes 106 and 108 may be disposed in remote cabinets connected to the main system via communication modules 102*c* to 108*c* that may provide for both control and audio buses and/or communications. The remaining remote nodes 106 and 108 may receive and pass-through the global paging output 114 via AC 106*d* and 108*d* that may provide for both control and audio buses and/or communications to, for example, AIC 106*e* and 108*e*, respectively. The remaining remote nodes 106 and 108 may further include amplifiers 106*b* and 108*b*. The amplifiers 106*b* and 108*b* may be configured to drive speakers 122*a* to 122*d* and 124*a* to 124*d*. In an alternate embodiment, it may be desirable to communicate the global paging output 114 over the same medium utilized to drive the speakers 122*a* to 122*d* and 124*a* to 124*d*.

Figure 2:
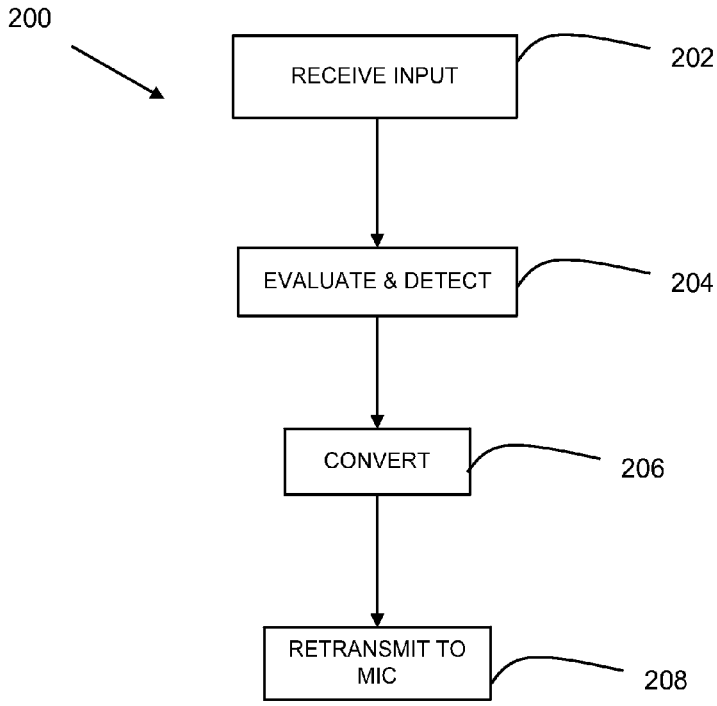
FIG. 2 illustrates an exemplary flowchart of the operation of the system shown in FIG. 1.

FIG. 2 illustrates a flowchart 200 representative of the operation of an exemplary wide area fire safety and detection system. At block 202, a signal representative of an audio input signal or communication may be received at the exemplary wide area fire safety and detection system. At block 204, information carried or provided via the received audio input signal may be detected and evaluated to determine the communication format and/or information carried therein. At block 206, the received and evaluated audio input signal may be converted into a different communication format or protocol and/or a different wattage or power level. At block 208, the converted communication may be communicated, in a receivable and/or usable format, to a microphone input.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

What is claimed is:

1. A wide area fire safety and detection system comprising:

a control node configured to execute a first detection routine, wherein the control node comprises:

a network interface; and an amplifier having an audio output, wherein the amplifier is configured to communicate the audio output to a plurality of fire safety nodes;

a remote node in communication with the control node, wherein the remote node comprises:

a network interface configured for communication with at least the network interface of the control node;

an audio converter configured to receive the audio output and generate a converted audio output, wherein the converted output is compatible with a microphone input.

2. The system of claim 1, wherein the fire safety nodes are selected from the group consisting of: microphones, fire detectors, fire alarms and fire indicators.

3. The system of claim 1, wherein the amplifier includes a first amp configured to generate a first audio output and a second amplifier configured to generate a second audio output.

4. The system of claim 3, wherein the audio converter is configured to receive the first and second audio outputs to generate the converted audio output.

5. The system of claim 1, wherein the amplifier is selected from the group consisting of: a 30-Watt amplifier, a 40-Watt amplifier and a 180-Watt amplifier.

6. The system of claim 1, wherein the network interfaces are configured to communicate status information related to the audio converter between the remote node and the control node.

7. The system of claim 1, wherein the audio converter is configured to convert the audio output from a first output format to a second output format.

8. An audio converter comprising:

a first audio input configured to receive a first audio output from a first amplifier;

a second audio input configured to receive a second audio output from a second amplifier;

an audio converter module configured to convert the first audio output from a first audio format to a second audio format and configured to convert the second audio output from a third audio format to the second audio format; and an audio output configured to communicate a third audio output in the second audio format to a microphone input.

9. A method of audio communication comprising:

receiving a first audio input provided by a first audio output of a first amplifier;

receiving a second audio input provided by a second audio output of a second amplifier;

converting the first audio output from a first audio format to a second audio format; and converting the second audio output from a third audio format to the second audio format; and communicating a third audio output in the second audio format to a microphone input.

10. The method of claim 9 further comprising: communicating control information via a network communication module.

11. The method of claim 10, wherein the control information includes information selected from the groups consisting of: alarm information, status information, and maintenance information.

* * * * *